US009872375B2

(12) United States Patent
Marhauser et al.

(10) Patent No.: US 9,872,375 B2
(45) Date of Patent: Jan. 16, 2018

(54) METHOD FOR ENERGY RECOVERY OF SPENT ERL BEAMS

(71) Applicant: JEFFERSON SCIENCE ASSOCIATES, LLC, Newport News, VA (US)

(72) Inventors: Frank Marhauser, Yorktown, VA (US); Fay Hannon, Poquoson, VA (US); Robert Rimmer, Yorktown, VA (US); R. Roy Whitney, Newport News, VA (US)

(73) Assignee: JEFFERON SCIENCE ASSOCIATES, LLC, Newport News, VA (US)

( * ) Notice: Subject to any disclaimer, the term of this patent is extended or adjusted under 35 U.S.C. 154(b) by 0 days.

(21) Appl. No.: 15/415,298

(22) Filed: Jan. 25, 2017

(65) Prior Publication Data

US 2017/0215269 A1 Jul. 27, 2017

Related U.S. Application Data

(60) Provisional application No. 62/287,202, filed on Jan. 26, 2016.

(51) Int. Cl.
*H05H 7/22* (2006.01)

(52) U.S. Cl.
CPC ..... *H05H 7/22* (2013.01)

(58) Field of Classification Search
None
See application file for complete search history.

(56) References Cited

U.S. PATENT DOCUMENTS 5,525,864 A * 6/1996 Butler ..... H01J 23/24 315/3.6

OTHER PUBLICATIONS

Ainsworth, R., et al., Asymmetric dual axis energy recovery linac for . . . , Physical Review Accelerators and Beams, 2016, 0803502-0803502-15, American Physical Society.

* cited by examiner

*Primary Examiner* — Jany Richardson

(57) ABSTRACT

A method for recovering energy from spent energy recovered linac (ERL) beams. The method includes adding a plurality of passive decelerating cavities at the beam dump of the ERL, adding one or more coupling waveguides between the passive decelerating cavities, setting an adequate external Q (Qext) to adjust to the beam loading situation, and extracting the RF energy through the coupling waveguides.

1 Claim, 5 Drawing Sheets

METHOD FOR ENERGY RECOVERY OF SPENT ERL BEAMS

CROSS-REFERENCE TO RELATED APPLICATIONS

This application claims the benefit of Provisional U.S. Patent Application Ser. No. 62/287,202 filed Jan. 26, 2016.

GOVERNMENT LICENSE RIGHTS STATEMENT

The United States Government may have certain rights to this invention under Management and Operating Contract No. DE-AC05-06OR23177 from the Department of Energy.

FIELD OF THE INVENTION

The present invention relates to energy recovery linacs (ERL) and more particularly to improving the energy recovery in a spent beam.

BACKGROUND OF THE INVENTION

In a conventional Energy Recovery Linac (ERL) the spent electron beam energy is not completely recovered. As shown in FIG. 1, an ERL includes an electron gun 10 that injects high energy particles, such as electrons, through a booster 12, into a beam line 14. Magnets 16 direct the path of the electrons through a linac (linear accelerator) 18 which increases the speed and energy of the electrons. Bending magnets 20 direct the beam 22 through a user device 24 and again through the linac 18 in which the unused beam energy is recovered. The spent beam 26 is then stopped in a high power beam dump 28, which results in several MeV of wasted energy. The booster 12 is not energy recovered and the spent beam 26 still contains a lot of energy that must be absorbed in the beam dump.

As shown in FIG. 2, low power RF 30 is input to the linac 18 to accelerate the electrons. In the conventional ERL, the booster 12 requires a substantial amount of high-power RF 32 to accelerate the high current beam 22. The spent beam 26 contains a lot of energy that must be absorbed in the high power beam dump 28 and may produce a serious radiation hazard.

Accordingly, there is a need to recover the energy in a spent beam with high efficiency and transfer the energy back to a consumer for reuse, such as to the ERL injector cryomodules. Such an energy recovery method would be advantageous to any accelerator facility with a dumped beam, such as a beam stop, with a beam power considerably high such that a recovery would yield a significant RF energy and cost saving.

OBJECT OF THE INVENTION

A first object of the invention is to provide a method for recovering energy from a spent energy recovery linac (ERL) beam.

A second object of the invention is to provide a method for recovering the energy in a spent beam with high efficiency.

A further object is to provide a method for transferring the energy from a spent beam back to a consumer for reuse, such as to the ERL injector cryomodules.

Another object is to provide a recovery method for spent beams that would yield a significant RF energy and cost saving for operation of the ERL.

A further object is of the invention is to significantly reduce the power to be dumped thereby resulting in a simpler and much less hazardous beam dump.

These and other objects and advantages of the present invention will be better understood by reading the following description along with reference to the drawings.

SUMMARY OF THE INVENTION

The present invention is a method for recovering energy from spent energy recovered linac (ERL) beams. The method includes adding a plurality of passive decelerating cavities at the beam dump of the ERL, adding one or more coupling waveguides between the passive decelerating cavities, setting an adequate external Q (Qext) to adjust to the beam loading situation, and extracting the RF energy through the coupling waveguides.

DETAILED DESCRIPTION

The present invention is a method for solving the problem of wasted energy in spent beams, such as in the typically not fully energy recovered electrons in the recirculating path of an Energy Recovery Linac.

Since an ERL is destined to operate at high average beam currents (greater than 1 mA), the corresponding beam power can be significant. As an example, at 100 mA and 10 MeV an RF power repository as high as 1 MW would be available that could be reused, for instance transferred back to the electron injector.

Figure 1:
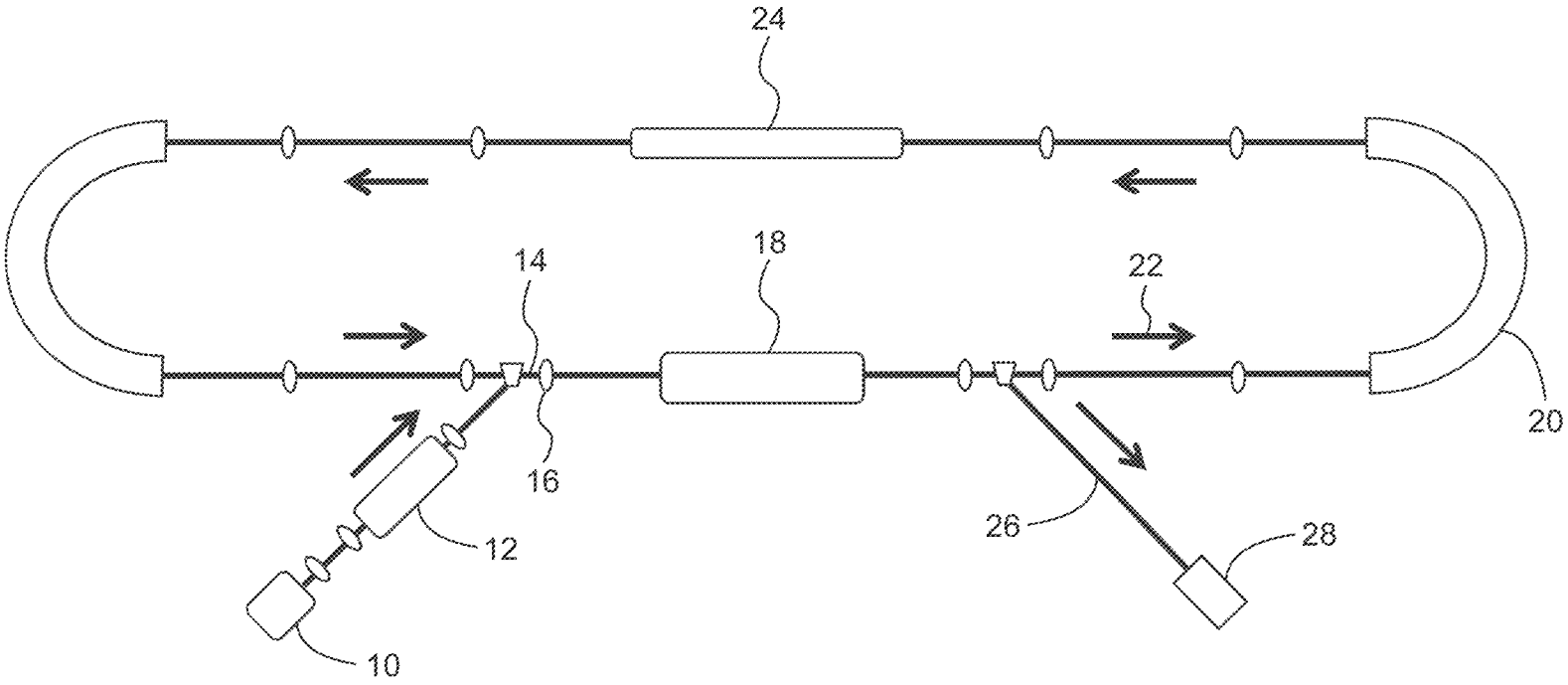
Fig. 1 (PRIOR ART)
FIG. 1 depicts the layout of a prior art energy recovery linac including a beam dump.
Figure 2:
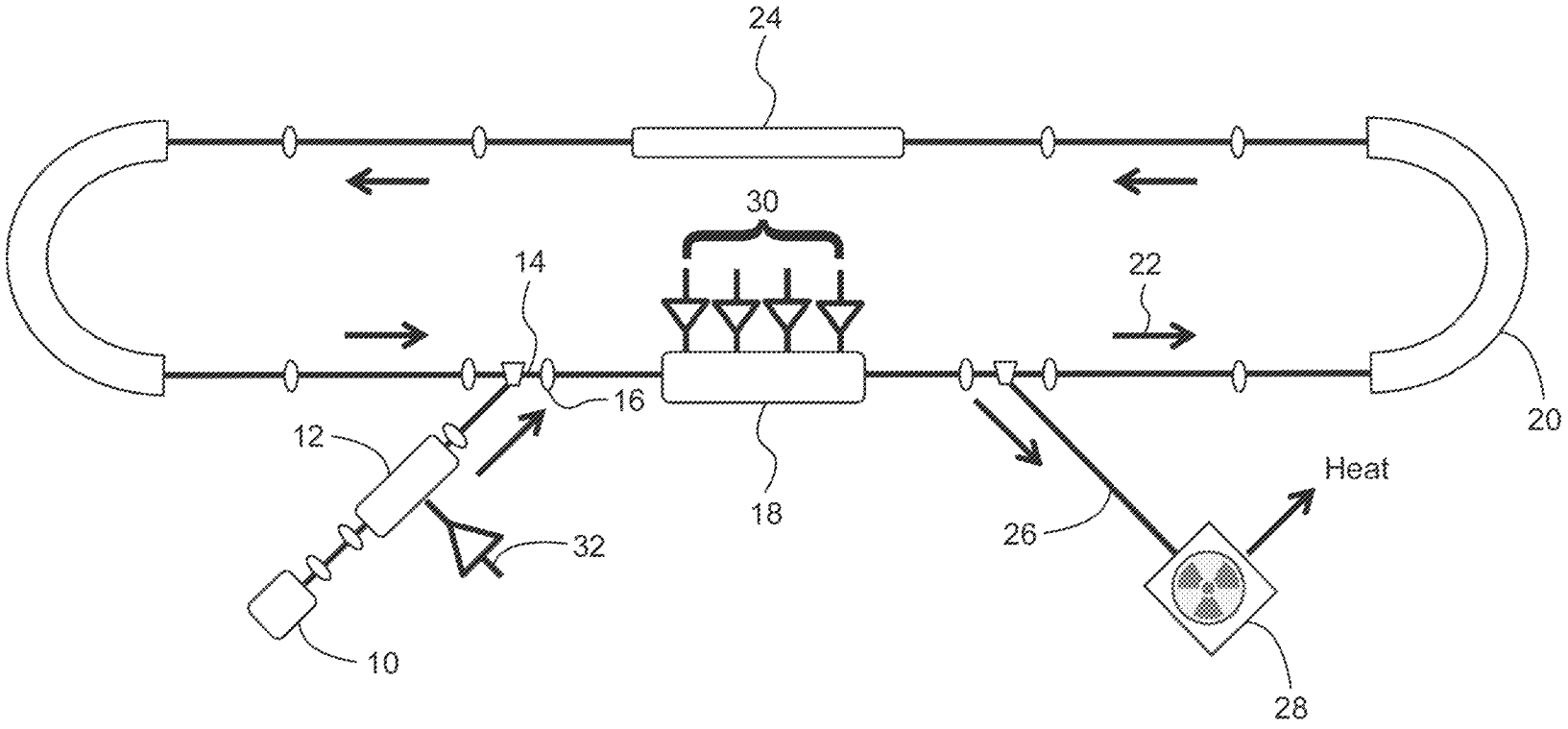
Fig. 2 (PRIOR ART)
FIG. 2 depicts prior art energy recovery linac of FIG. 1, depicting the loss of several MeV of wasted energy in the beam dump.
Figure 3:
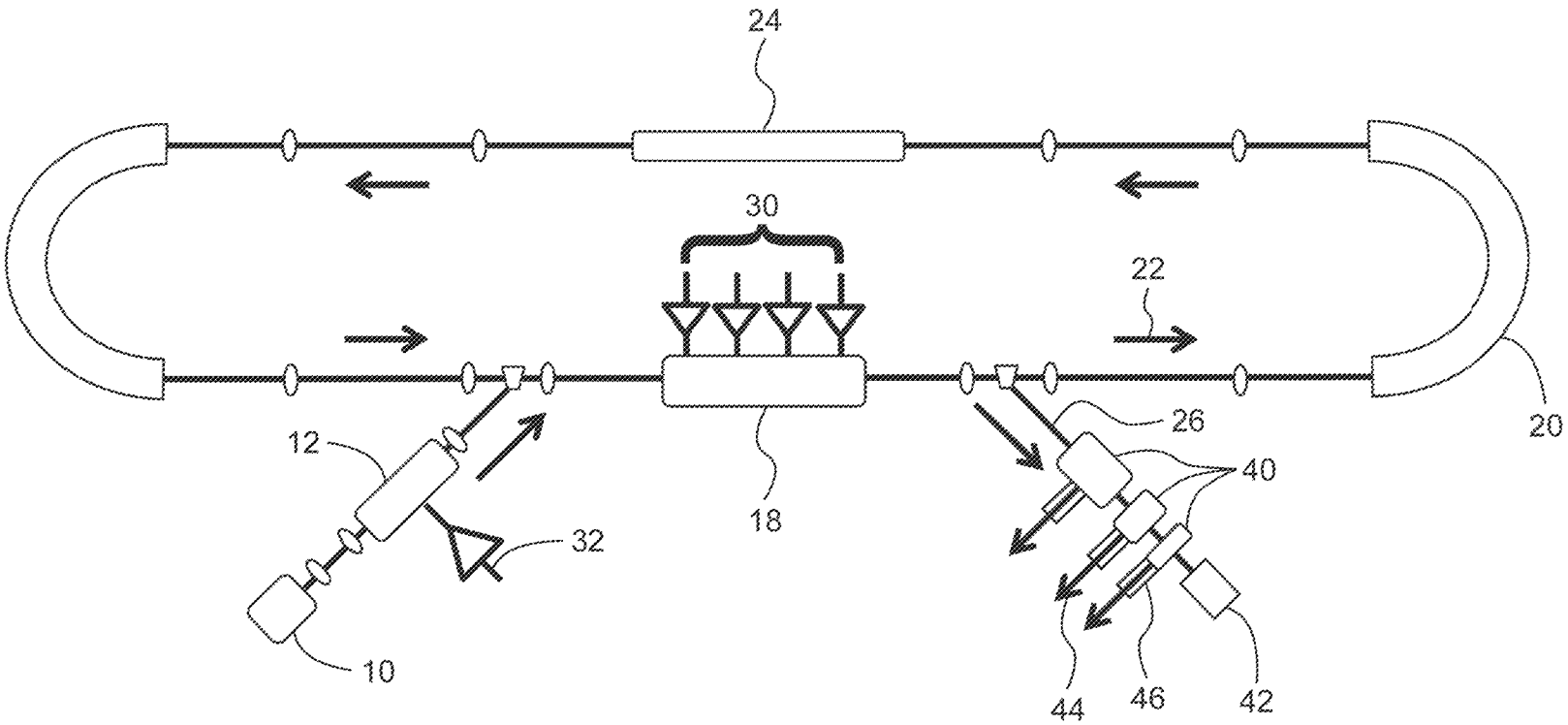
FIG. 3 depicts the layout of an energy recovery linac according to the present invention, in which passive decelerating cavities are used to extract the RF energy and enable the use of a low power beam dump.
Figure 4:
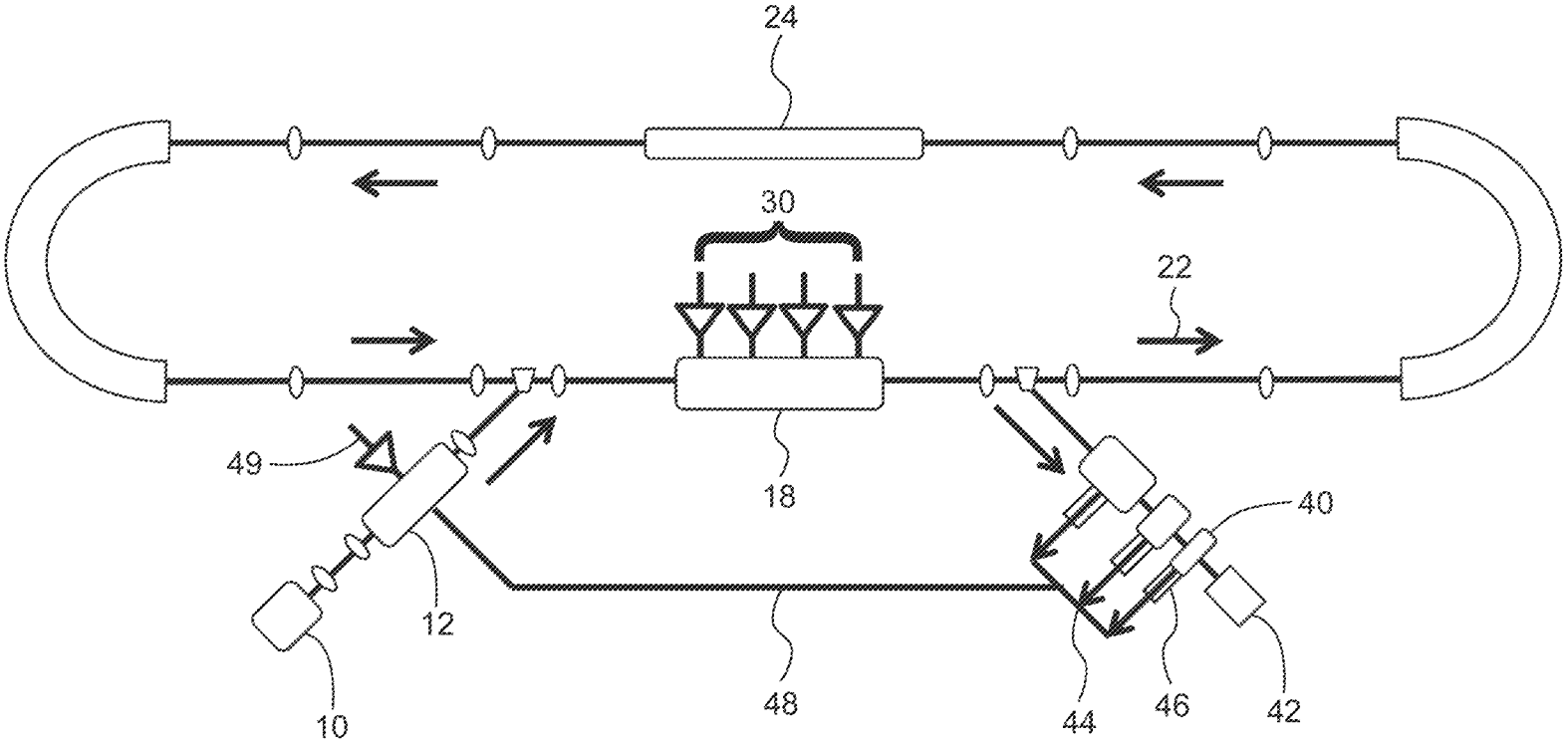
FIG. 4 depicts the layout of an energy recovery linac according to the present invention, in which decelerating cavities recover RF power from the spent beam and return it to the booster, minimizing the dump size, minimizing the radiation hazard, and reducing the RF power required at the booster to establish fields in the cavities.

With reference to FIG. 3, according to the present invention, the unused RF energy is regained by adding one or more passive decelerating cavities 40 in the path of the spent beam 26. The passive decelerating cavities 40 extract most of the energy from the spent beam 26 minimizing the dump size, enabling the use of a low power beam dump 42, and greatly reducing the radiation hazard. Instead of being wasted in a high energy beam dump, the RF energy 44 is extracted through coupling waveguides 46 adjustable to the beam loading situation by choosing an adequate external quality factor ($Q_{ext}$). The booster requires a lot of RF power to accelerate the high current beam As shown in FIG. 4, in an ERL according to the present invention, the decelerating cavities 40 recover RF power 44 from the spent beam 26 and return it through an RF recovery structure 48 to the booster 12, minimizing the beam dump radiation hazard. Supplemented by the recovered RF, as compared to the convention ERL, the booster 12 requires only modest RF power 30 to establish fields in the cavities. As a result of the RF power returned, only low power input 49 is required at the booster 12.

Figure 5:
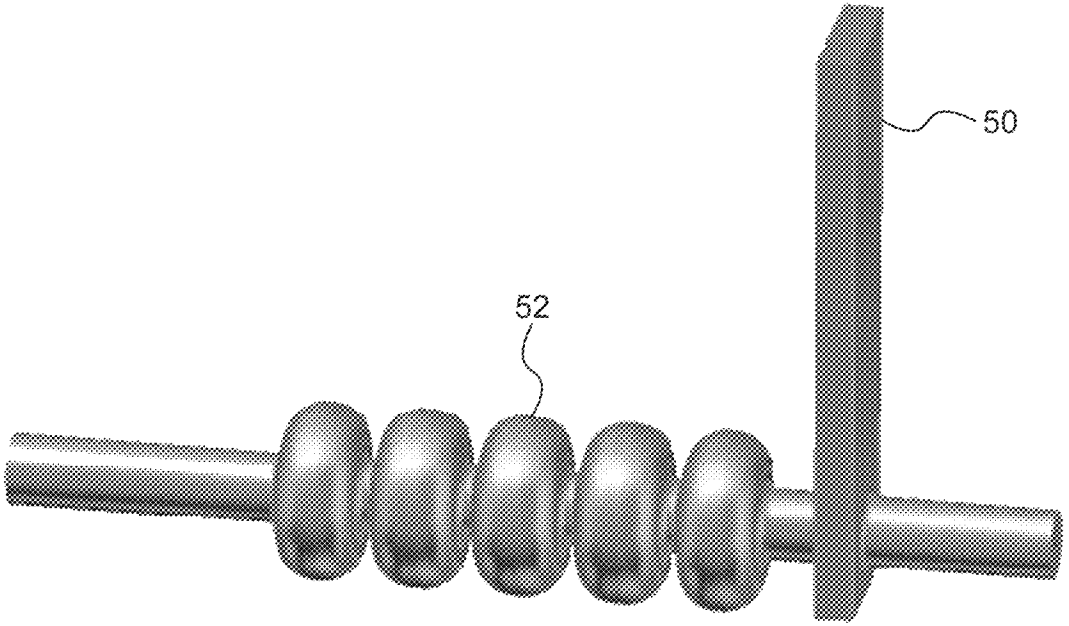
FIG. 5 is an isometric view of a decelerating five-cell SRF cavity ($\beta$=1) with one rectangular waveguide, scalable to any frequency, to couple out RF energy.

Referring to FIG. 5, a rectangular waveguide 50 may be used to couple out the RF energy. The waveguide location and size determines the value of $Q_{ext}$ (RF-window not shown). Single-cell or multi-cell RF cavities 52 can be used to extract most of the energy from the spent beam. Several cavities may be installed in series to extract portions of the beam power that the spent ERL beam carries. With the beam decelerating gradually to non-relativistic energies, the RF cavities can be designed as speed-of-light structures ($\beta$=1) to low-$\beta$ structures for optimum energy extraction. The RF energy extracted from multiple cavities can be combined in the external transmission utilizing waveguide combiners and phase shifters.

The invention solves the problem of wasted RF energy of spent beams, such as the typically not fully recovered energy electrons in the recirculating path of a conventional Energy Recovery Linac, in which the RF power repository can be in the hundred kW to MW range usually wasted in a beam dump. With the method of the present invention, the energy is not wasted but is recovered with high efficiency and transferred back to a consumer for reuse, such as in the ERL injector cryomodules.

A critical feature of the present invention is the recovery of the RF power repository of spent beams. According to the present invention, superconducting RF cavities are the preferred choice for efficient recovery of the energy of a spent beam. Limitations may depend on the start beam parameters. Other than individual on-site space constraints, there are no restrictions to the integration of focusing magnets between cavities to steer the beam through several cavity sections of different velocity profile.

The design of the passive decelerating cavity or cavities depends on the RF frequency and bunch pattern (i.e. bunch charge and bunch repetition rate determines beam current). The RF energy is out-coupled via a waveguide port (coaxial or rectangular waveguide) from each cavity. Rectangular waveguides are used to transmit high power levels. The value of the external Q ($Q_{ext}$) of the waveguide port together with the number of cavity cells determines the total voltage and thus energy excited in the cavity in the saturated state. This also determines the decelerating field ($E_{dec}$) and RF energy extractable per cavity, respectively. The $Q_{ext}$-value of a cavity is adjusted by design. The $Q_{ext}$-value is chosen such that the stored energy is not decayed significantly from bunch to bunch. This favors SRF cavities since the $Q_{ext}$-value required can be high ($Q_{ext}>10^5$). SRF cavities further enable negligible losses in cavity walls compared to copper structure and enable operation of the cryogenic cooling system at a helium temperature of 4.5K instead of 2K.

Analytical Description:

Complex voltage (V) in saturated state for point-charge bunches is:

$$\vec{V}_{N_{b\to\infty}} = 2\cdot q\cdot \kappa_z \frac{1}{1-e^{i\Delta\varphi}e^{-\alpha}}\cdot e^{\frac{1\omega}{2Q_l}} e^{i\omega t} \tag{1}$$

$$\alpha = \frac{1}{2}\frac{\omega}{Q_l}\cdot(T_b+\Delta t_n) \tag{2}$$

where $N_b$=number of bunches, q=bunch charge, $\kappa_z$=longitudinal loss factor of fundamental RF mode, $\omega$=angular RF frequency, $Q_1$=loaded Q of RF cavity (~$Q_{ext}$ for SRF structure), $T_b$=bunch-to-bunch spacing (assumed constant for CW beam), $\Delta t_n$ is possible jitter from bunch to bunch and may vary from bunch-to-bunch, and $\Delta\varphi$=corresponding phase change from bunch to bunch. (Note: The RF system does not allow for a phase slippage to occur, since ERL beam must be kept in synchronization with RF).

Average power per cavity is:

$$P_{ave} = \frac{1}{T_b}\int_0^{T_b} dt \frac{\left|\vec{V}_{N_{b\to\infty}}(t)\right|^2}{R} = \kappa_z\cdot q\cdot I_{ave}\cdot P_{gain}(Q_l) \tag{3}$$

where R=shunt impedance of cavity, $I_{ave}$=average beam current, $P_{gain}$ is approximately twice the real voltage gain for a given $T_b$ in steady state and for a single bunch passage, and $Q_l/Q_{ext}$ determines power/energy extracted.

Although the description above contains many specific descriptions, materials, and dimensions, these should not be construed as limiting the scope of the invention but as merely providing illustrations of some of the presently preferred embodiments of this invention. Thus the scope of the invention should be determined by the appended claims and their legal equivalents, rather than by the examples given.

What is claimed is:

1. A method for recovering energy from a spent energy recovery linac (ERL) having an electron beam, comprising:

an electron gun injecting electrons to form the electron beam;

a linear accelerator (linac) accelerating the electron beam;

adding a booster at the exit of the electron gun to provide radio frequency (RF) power for accelerating the electrons exiting the electron gun;

a spent beam directing a portion of the electron beam to a beam dump;

adding one or more passive decelerating cavities to the spent beam leading to the beam dump;

adding one or more coupling waveguides between the passive decelerating cavities;

setting the external quality factor ($Q_{ext}$) of the coupling waveguides to the beam load;

extracting the RF energy through the coupling waveguides; and returning the extracted RF energy to the booster.

* * * * *